US006305359B1

(12) United States Patent
Kronberger et al.

(10) Patent No.: US 6,305,359 B1
(45) Date of Patent: Oct. 23, 2001

(54) FUEL INJECTION VALVE FOR INTERNAL COMBUSTION ENGINES

(75) Inventors: Maximilian Kronberger, Steyr; Herbert Strahberger, Gallneukirchen, both of (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/555,414

(22) PCT Filed: Sep. 29, 1999

(86) PCT No.: PCT/DE99/03140

§ 371 Date: Sep. 20, 2000

§ 102(e) Date: Sep. 20, 2000

(87) PCT Pub. No.: WO00/19089

PCT Pub. Date: Apr. 6, 2000

(30) Foreign Application Priority Data

Sep. 30, 1998 (DE) ..... 198 44 891

(51) Int. Cl.[7] ..... F02M 33/04
(52) U.S. Cl. ..... 123/506; 123/496; 239/96
(58) Field of Search ..... 123/446, 497, 123/506, 496; 239/88–96, 533.4, 533.8

(56) References Cited

U.S. PATENT DOCUMENTS 4,546,739 * 10/1985 Nakajima et al. ..... 123/299
4,928,886 * 5/1990 Kronberger ..... 239/533.5
5,984,200 * 11/1999 Augustin ..... 239/88
5,984,201 * 11/1999 Hofmann et al. ..... 239/533.8
6,024,298 * 2/2000 Kelly ..... 239/533.8

* cited by examiner

*Primary Examiner*—Thomas N. Moulis
(74) *Attorney, Agent, or Firm*—Ronald E. Greigg; Edwin E. Greigg

(57) ABSTRACT

A fuel injection valve for internal combustion engines, having an axially movable valve member which, with its end oriented toward the combustion chamber, opens and closes a through flow cross section to at least one injection opening and which, with its end remote from the combustion chamber, protrudes into a fuel-filled spring chamber in which a valve spring is clamped, which acts on the valve member in the closing direction and is supported with its end remote from the valve member against a deflecting piston which, during the supply of high pressure fuel to the fuel injection valve, can be moved a certain distance into the spring chamber and thereby increases the initial stress force of the valve spring, and having a connecting conduit between the spring chamber and a low pressure fuel chamber. The connecting conduit between the spring chamber and the low pressure fuel chamber is embodied as a throttle bore in order to increase the injection opening pressure.

8 Claims, 1 Drawing Sheet

FUEL INJECTION VALVE FOR INTERNAL COMBUSTION ENGINES

BACKGROUND OF THE INVENTION

1. Field of the Invention

The invention is related to a fuel injection valve for internal combustion engines.

2. Description of the Prior Art

In a fuel injection valve of the type with which is invention is concerned, which is known from DE 39 00 763, a valve member is guided so that it can move axially in a guide bore of a valve body. With its end oriented toward the combustion chamber, the valve member controls a through flow cross section to at least one injection opening into the combustion chamber of the engine to be supplied. With its end remote from the combustion chamber, the valve member protrudes at least indirectly into a fuel-filled spring chamber in which a valve spring is clamped that acts on the valve member in the closing direction of the through flow cross section. This valve spring is supported with its end remote from the valve member against a deflecting piston which, during the supply of high fuel pressure to the fuel injection valve, can be moved a certain distance into the spring chamber and by means of this insertion, increases the initial stress force of the valve spring. The preinjection in the fuel injection valve is controlled by means of this increase in the initial stress force of the valve spring during the injection phase. The spring chamber containing the valve spring has a connecting conduit to a low pressure fuel chamber encompassing the valve body of the fuel injection valve. This low pressure fuel chamber is embodied as an intake chamber for a high pressure fuel pump which, together with the fuel injection valve, constitutes a component and is connected to the fuel injection valve by means of a clamping nut. This component is then inserted into a corresponding receiving opening of the housing of the engine to be supplied, wherein the control of the high pressure delivery to the high pressure fuel pump and consequently the high pressure fuel injection at the fuel injection valve takes place by means of an electric control valve, preferably a solenoid valve, which is connected laterally to the housing of the high pressure fuel pump.

In this connection, however, the fuel injection valve has the disadvantage that the closing force of the valve spring is not enough to also produce very high injection opening pressures in the fuel injection valve. Furthermore, with the known fuel injection valve, when the valve member is opened rapidly, an oscillation of the valve spring and consequently also of the components connected to it—particularly of the valve member—can occur, which has a disadvantageous effect on the actually prevailing injection opening pressure and as a result, on the metering precision of the injection quantity in the fuel injection valve.

SUMMARY OF THE INVENTION

The fuel injection valve for internal combustion engines according to the invention, has the advantage over the prior art that the closing forces acting on the valve member during the main injection phase can be sharply increased while the structural dimensions remain the same. This increase in the closing forces acting on the valve member is achieved through the advantageous provision of a throttle between the spring chamber and a low pressure fuel chamber, which limits the escape of the fuel disposed in the spring chamber. In this manner, in addition to the increase of the initial spring stress of the valve spring when the deflecting piston is inserted into the spring chamber also produces an increase in the hydraulic closing force, wherein the additional hydraulic closing force approximately corresponds to the closing force of the valve spring. Consequently, the closing force can be increased approximately by a factor of 2 in comparison to conventional fuel injection valves. The increased closing forces on the valve member thereby produce a significant increase in the necessary injection opening pressure in the fuel injection valve so that an improved fuel injection characteristic curve can be produced in the injection valve, which has a positive influence on the fuel preparation and combustion in the combustion chamber of the engine to be supplied, particularly in the engine map region that is sensitive to emissions and consumption. The magnitude of the additional hydraulic closing force is thereby influenced by the throttle diameter, the total stroke of the deflecting piston, and the shaft diameter of the nozzle needle, wherein the increase in the injection opening pressure and the maximal injection pressure during the main injection phase becomes apparent particularly at low and medium engine speeds. The intensified increase thereby occurs with the small injection quantities, which are important for emissions measurements and in which the peak pressures of the high pressure delivery pump are hardly ever greater than the injection opening pressures. At the nominal speed and maximal quantity, however, due to the short cycle times, there is advantageously no significant increase in the maximal injection opening pressure.

Another advantage of providing a throttle opening between the spring chamber and the low pressure fuel chamber encompassing the valve holding body is the damping effect of the hydraulic pressure in the spring chamber, which suppresses oscillations of the valve spring and consequently fluctuations of the injection opening pressure.

The pressure in the spring chamber, which only decreases slowly due to the throttle action, furthermore advantageously encourages the closing of the valve member with increasing force as the speed increases, which is particularly advantageous due to the short diversion times at high speeds. In addition, less cavitation is produced in the high pressure region after the closing of the valve member, which reduces the subsequent filling stroke in it. This permits the reduction of noise emission and the risk of an undesirable reopening of the valve member.

The provision, according to the invention, of a throttle relief bore of the spring chamber in connection with a deflecting piston that reduces the volume of the spring chamber is shown in the exemplary embodiment of a so-called unit fuel injector, but can also be used in other injection systems which provide a deflecting piston in the spring chamber of the fuel injection valve.

BRIEF DESCRIPTION OF THE DRAWINGS

Other objects and advantages of the invention will be apparent from the detailed description contained hereinbelow, taken in conjunction with the drawing, in which the single is a longitudinal section through the part of the above-described fuel injection valve for internal combustion engines that is essential to the invention.

DESCRIPTION OF THE PREFERRED EMBODIMENT

Figure 1:
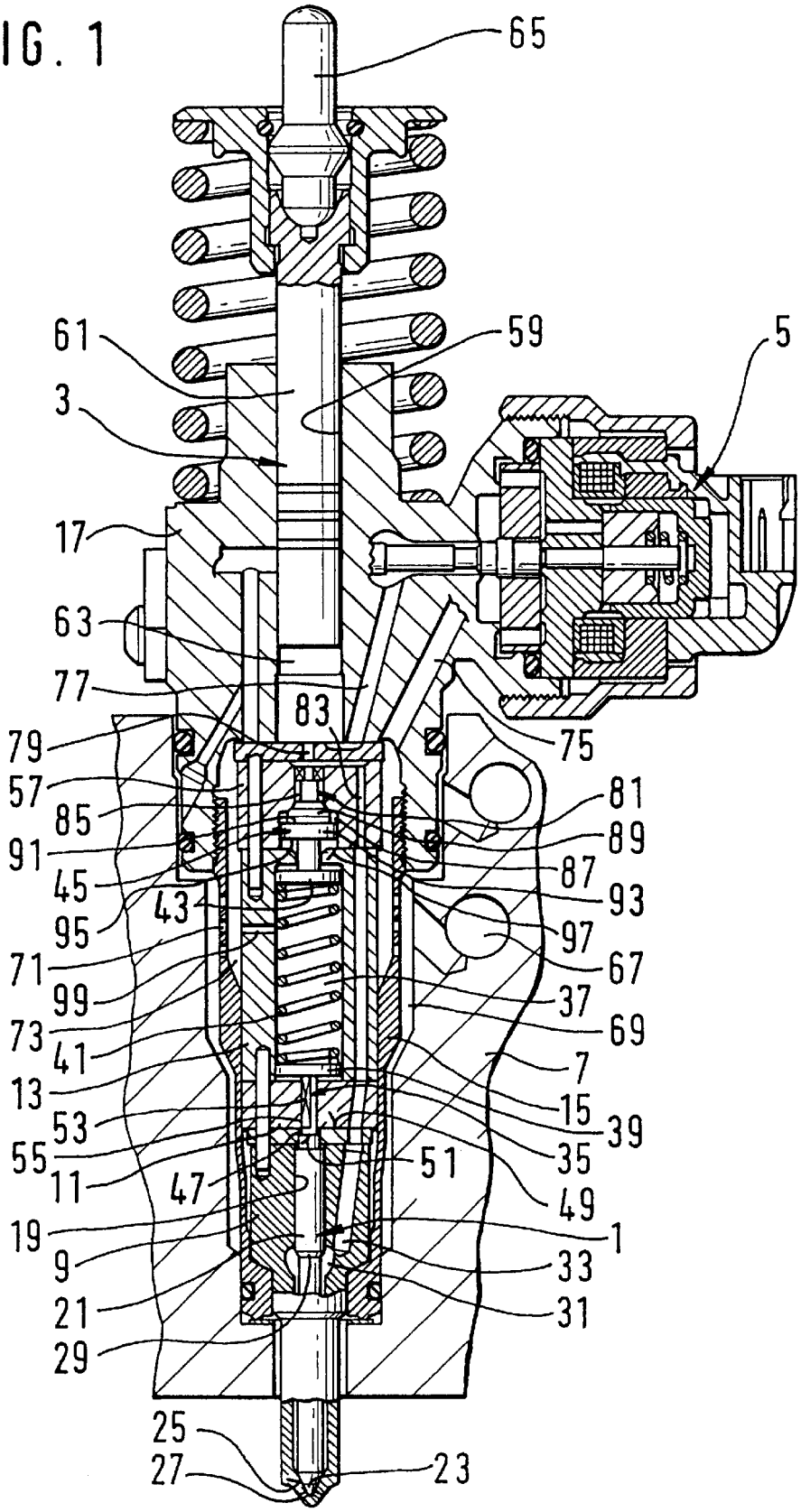

The exemplary embodiment of the fuel injection valve according to the invention shown in FIG. 1 indicates the fuel injection valve 1 in a component with a high pressure fuel pump 3, which component has an electric control valve 5 disposed on it and is inserted as a component into a housing 7 of the engine to be supplied.

The fuel injection valve 1 has a valve body 9 which, with its one end, protrudes into a combustion chamber, not shown in detail, of the engine to be supplied and with its other end, with the interposition of an intermediary disk 11, is clamped axially against a valve holding body 13. This axial clamping is achieved by means of a clamping nut 15, which encompasses a shoulder on the valve body 9 and which is screwed into a thread of a housing 17 of the high pressure fuel pump 3. The valve body 9 of the fuel injection valve 1 also has a guide bore 19 in which a piston-shaped valve member 21 is guided so that it can move axially. In a known manner, on its end oriented toward the combustion chamber, the valve member 21 has a valve sealing face 23 which it uses to cooperate with a valve seat face 25 at the closed-end of the guide bore 19 in order to control an injection opening cross section. Downstream of the sealing cross section between the sealing face 23 and the valve seat face 25, injection openings 27 lead away from the valve seat face 25 and feed into the combustion chamber of the internal combustion engine. The valve member 21 also has a pressure shoulder 29 on its shaft, pointing in the direction of the opening stroke, with which it protrudes into a pressure chamber 31 which is formed by a cross sectional enlargement of the guide bore 19. This pressure chamber extends to the valve seat face 25 and can be filled with high pressure fuel by means of a high pressure fuel conduit 33. On its end remote from the combustion chamber, the valve member 21 also has a pressure pin 35, which passes through the intermediary disk 11 and feeds into a cross-sectionally enlarged spring chamber 37 in the valve holding body 13. In this connection, a lower spring plate 39 is provided on the end of the pressure pin 35 oriented toward the spring chamber and a valve spring 41, which is clamped in the spring chamber 37, rests against the other side of this spring plate and thereby acts on the valve member 21 in the closing direction toward the valve seat face 25. On the other end, this valve spring 41 is supported against an upper spring plate 43 which, on its side remote from the spring, rests against a deflecting piston 45.

With its pressure pin 35, the valve member 21 protrudes into a fuel-filled damping chamber 47, which is defined by a stationary shoulder 49 formed by the end face of the intermediary disk 11 and this shoulder thereby forms a stroke stop for an annular shoulder 51 on the valve member 21. Between the wall of the damping chamber 47 and the pressure pin 35, a throttle cross section is formed, which is embodied as a flat ground area 53 and is used to connect the damping chamber 47 to the spring chamber 37. The flat ground area 53 on the pressure pin 35 has an axial spacing from the annular shoulder 51 on the valve member 21 in the vicinity of which the pressure pin 35 corresponds to the diameter of the receiving opening in the intermediary disk 11 so that a control edge 55 is formed whose passage beyond the shoulder 49 triggers the closing of the hydraulic damping chamber 47.

The housing 17 of the high pressure fuel pump 3 is clamped axially against the valve holding body 13 via an intermediary piece 57 by means of the clamping nut 15. The high pressure fuel pump 3 has a pump piston 61 that can be moved axially in a cylinder bore 59 and, with its inserted end face, defines a pump work chamber 63 in the cylinder bore 59. For the high pressure fuel delivery, the pump piston 61 is driven to reciprocate via a tappet push rod 65 by means of a motor-driven cam drive that is not shown in detail. The supply of low pressure fuel takes place by way of a supply line 67 in the motor housing 7 into an annular chamber 69 encompassing the fuel injection valve 1, which chamber is connected by means of filter openings 71 in the clamping nut 15 to an intake chamber 73 that is formed between the clamping nut 15 and the valve holding body 13. From this intake chamber 73, a first control line 75 leads to the electric control valve 5, which is embodied in a known manner as a solenoid valve and, in a manner not shown in detail, controls the overflow of fuel into a second control line 77 as a function of the operating parameters of the engine to be supplied, by means of an electric control unit. This second control line 77 likewise passes through the housing 17 of the high pressure fuel pump 3 and feeds into the pump work chamber 63. In addition, a bore 79 leads from the pump work chamber 63 and feeds into a through opening in the intermediary piece 57, which thereby constitutes a hydraulic work chamber 81. In addition, the bore 79 is connected by means of connecting conduits 83 to the high pressure fuel conduit 33 which passes through the valve body 9 and the valve holding body 13 and thus produces the hydraulic connection between the pump work chamber 63 and the pressure chamber 31 and also the valve seat 25.

The hydraulic work chamber 81 has two different diameters, wherein a first smaller diameter region 85 is continuously connected to the pump work chamber 63 of the high pressure fuel pump 3 by way of the bore 79. A second larger diameter region 87 of the hydraulic work chamber 81 can be connected to the pump work chamber 63 only after a through flow cross section is opened by means of the stroke motion of the deflecting piston 45. To this end, the deflecting piston 45 has two different hydraulic force introduction surfaces, of lwhich a first smaller force introduction surface 89 defines the smaller diameter hydraulic work chamber part 85. A second larger force introduction surface 91 is formed on an annular collar 93 on the deflecting piston 45 and defines the larger diameter region 87 of the hydraulic work chamber 81. With its lower annular end face remote from the force introduction surface 91, the annular collar 93 constitutes a stop face 95, which cooperates with a stationary stroke stop face 97 in order to limit the stroke motion of the deflecting piston 45. The stroke stop face 97 is connected to the end face of the valve holding body 13 remote from the combustion chamber. With its lower end remote from the pump work chamber 63, the deflecting piston 45 protrudes into the spring chamber 37 and is attached to the upper spring plate 43 there.

In order to influence the opening stroke characteristic curve and consequently the characteristic curve of the injection jet in the fuel injection valve 1, a connecting conduit is embodied as a throttle bore 99 between the spring chamber 37 and the intake chamber 73 that constitutes a low pressure fuel chamber, and the additional hydraulic closing force on the fuel injection valve 1 can be adjusted by means of the diameter of this throttle bore.

The fuel injection valve for internal combustion engines according to the invention functions in the following manner. During the intake stroke of the high pressure fuel pump 3, when the pump piston 61 is moved upward, fuel is aspirated into the pump work chamber 63 from the intake chamber 73 via the first control line 75, the open electric control valve 5, and the second control line 77. The valve member 21 of the fuel injection valve 1 is kept in the closed position against the valve seat 25 by means of the valve spring 41. With the beginning of the downwardly directed delivery stroke of the pump piston 61 of the high pressure fuel pump 3, first a part of the fuel from the pump work chamber 63 is conveyed back into the intake chamber 73 via the same path. Depending on the operating parameters of the engine to be supplied, the electric control valve controls the beginning time and also the ending time of the high pressure delivery of the high pressure fuel pump 3 to the fuel injection valve 1. The high pressure fuel delivery and thereby the fuel injection in the fuel injection valve 1 are initiated by the closing of the through flow cross section between the control lines 75 and 77 at the electric control valve 5. As a result of this, with the downwardly directed delivery stroke of the pump piston 61, a high fuel pressure is built up in the pump work chamber 63, which travels via the bore 79, the conduit 83, and the high pressure fuel conduit 33 to the pressure chamber 31 in the fuel injection valve 1. After the necessary injection opening pressure is exceeded there, the fuel injection valve opens in a known manner by means of the valve member 21 lifting up from the valve seat 25 so that the high pressure fuel travels from the pressure chamber 31 via the injection openings 27 and reaches injection into the combustion chamber of the internal combustion engine.

The fuel injection in the fuel injection valve according to the invention is divided into a preinjection quantity and a main injection quantity, wherein during the preinjection phase, the valve member 21 only travels a limited opening stroke path initially, which is limited by the control edge 55 on the valve member 21 traveling past the shoulder surface 49 of the intermediary disco 11 as a result of which the damping chamber 47 in the fuel injection valve 1 is closed so that the closing force on the valve member 21 increases. At the same time, with the currently prevailing high injection pressure, the deflecting piston 45 begins to lift up from its seat and is moved in the direction of the spring chamber 37 as a result of the high fuel pressure currently acting on the first force introduction surface 89 and, after the deflecting piston 45 lifts up from the seat, acting on the second force introduction surface 91. This movement of the deflecting piston 45 toward the spring chamber 37 produces an increase of the initial spring stress of the valve spring 41 and also, because of the throttled escape of fuel from the spring chamber 37, produces an increase in the hydraulic pressure in the spring chamber 37 due to its volume reduction so that the total closing forces currently acting on the valve member 21 exceed the prevailing opening force and thus move the valve member 21 back against its valve seat 25 so that the preinjection phase is ended. Then, in the continued course of the high pressure fuel delivery stroke of the pump piston 61, the high fuel pressure in the pump work chamber 63 and in the connected chambers of the fuel injection valve 1 increases again until the injection opening pressure necessary for the main injection is achieved. This injection opening pressure necessary for the main injection is determined by the currently increased spring force of the valve spring 41, the total stroke of the deflecting piston 45, and the throttle diameter of the throttle bore 99, which determine the additional hydraulic closing force in the spring chamber 37. After the injection opening pressure necessary for the main injection is exceeded, then the valve member 21 in turn lifts up from the valve seat 25 so that the main injection quantity then reaches injection in a known manner via the injection openings 27. By means of the above-mentioned additional hydraulic closing pressure on the valve member 21, it is thus possible to approximately double the injection opening pressure necessary for the main injection so that the main injection quantity can be injected with a higher injection pressure and consequently in a shorter time, particularly at low and medium speeds. This main injection phase advantageously begins shortly before the deflecting piston 45 reaches the stroke stop 97. The main injection is ended in a known manner by the opening of the electric control valve 5, which opens the hydraulic connection between the control lines 77 and 75 again so that the high fuel pressure in the pump work chamber 63 and in the high pressure lines inside the fuel injection valve 1 collapses. In this connection, the additional hydraulic closing pressure in the spring chamber 37, which can only decrease relatively slowly as a result of the throttle 99, encourages a rapid and reliable closing of the fuel injection valve, i.e. a rapid movement of the valve member 21 back into contact with the valve seat face 25.

The magnitude of the additional hydraulic closing force in the spring chamber 37 and its pressure decrease can be adjusted as a function of the total stroke of the deflecting piston 45 and the shaft diameter of the valve member 21 by means of the dimensioning of the throttle bore 99, wherein with a stroke path of the deflecting piston 45 of approximately 0.5 to 1 mm, the diameter of this throttle bore 99 preferably lies in a range from 0.4 to 1.2 mm.

Consequently, with the fuel injection valve according to the invention, the injection opening pressure in the fuel injection valve during the main injection phase can be significantly increased in comparison to conventional fuel injection valves without having to carry out significant changes in the design of the fuel injection valve and in particular of the valve spring 41.

The foregoing relates to preferred exemplary embodiments of the invention, it being understood that other variants and embodiments are thereof possible within the spirit and scope of the invention, the after being defined by the appended claims.

What is claimed is:

1. In a fuel injection valve for internal combustion engines, having an axially movable valve member (21) which, with its end oriented toward the combustion chamber, opens and closes a through flow cross section to at least one injection opening (27) and which, with its end remote from the combustion chamber, at least indirectly protrudes into a fuel-filled spring chamber (37) in which a valve spring (41) is clamped, which acts on the valve member (21) in the closing direction and is supported with its end remote from the valve member against a deflecting piston (45), which piston, during the supply of high pressure fuel to the fuel injection valve, can be moved by a certain stroke path into the spring chamber (37) and thereby increases the initial stress force of the valve spring (41), and having a connecting conduit between the spring chamber (37) and a low pressure fuel chamber (73), the improvement wherein the connecting conduit between the low pressure fuel chamber (73) and the spring chamber (37) is embodied as a throttle (99), and wherein a high pressure pump (3) that delivers high pressure fuel constitutes a component together with the fuel injection valve (1) and this component is adapted to be inserted into a housing (7) of the engine to be supplied, and wherein an electric control valve (5) is disposed on the high pressure pump (3) in order to control the high pressure delivery of the high pressure pump (3).

2. The fuel injection valve according to claim 1, wherein the throttle (99) is embodied as a throttle bore, whose diameter preferably lies in a range between 0.4 and 1.2 mm.

3. The fuel injection valve according to claim 2, wherein starting from the spring chamber (37), the throttle bore (99) feeds into the low pressure fuel chamber (73), which encompasses the fuel injection valve.

4. it a fuel injection valve for internal combustion engines, having an axially movable valve member (21) which, with its end oriented toward the combustion chamber, opens and closes a through flow cross section to at least one injection opening (27) and which, with its end remote from the combustion chamber, at least indirectly protrudes into a fuel-filled spring chamber (37) in which a valve spring (41) is clamped, which acts on the valve member (21) in the closing direction and is supported with its end remote from the valve member against a deflecting piston (45), which piston, during the supply of high pressure fuel to the fuel injection valve, can be moved by a certain stroke path into the spring chamber (37) and thereby increases the initial stress force of the valve spring (41), and having a connecting conduit between the spring chamber (37) and a low pressure fuel chamber (73), the improvement wherein the connecting conduit between the low pressure fuel chamber (73) and the spring chamber (37) is embodied as a throttle (99), wherein on its end remote from the combustion chamber, the valve member (21) has a pressure pin (35) which protrudes into a fuel-filled damping chamber (47), which is defined by a stationary shoulder (49) that constitutes a stroke stop for an annular shoulder (51) on the valve member (21), and wherein between the wall of the damping chamber (47) and the pressure pin (35) a throttle cross section is formed, which feeds into the spring chamber (37) and can be closed during the stroke motion of the valve member (21).

5. In a fuel injection valve for internal combustion engines, having an axially movable valve member (21) which, with its end oriented toward the combustion chamber, opens and closes a through flow cross section to at least one injection opening (27) and which, with its end remote from the combustion chamber, at least indirectly protrudes into a fuel-filled spring chamber (37) in which a valve spring (41) is clamped, which acts on the valve member (21) in the closing direction and is supported with its end remote from the valve member against a deflecting piston (45), which piston, during the supply of high pressure fuel to the fuel injection valve, can be moved by a certain stroke path into the spring chamber (37) and thereby increases the initial stress force of the valve spring (41), and having a connecting conduit between the spring chamber (37) and a low pressure fuel chamber (73), the improvement wherein the connecting conduit between the low pressure fuel chamber (73) and the spring chamber (37) is embodied as a throttle (99), wherein the deflecting piston (45) is guided in a hydraulic work chamber (81), which has two different diameters, wherein a first smaller diameter region (85) continuously communicates with a pump work chamber (63) of the high pressure pump (3) and a second larger diameter region (87) can be connected to the pump work chamber (63) only after the opening of a through flow cross section through a stroke motion of tho deflecting piston (45) and that the deflecting piston (45) has two different hydraulic force introduction surfaces of which a first smaller force introduction surface (89) adjoins the first smaller diameter region (85) of the hydraulic work chamber (81) and a second larger force introduction surface (91) is disposed in the second larger diameter region (87) of the hydraulic work chamber (81).

6. In a fuel injection valve for internal combustion engines, hasting an axially movable valve member (21) which, with its end oriented toward the combustion chamber, opens and closes a through flow cross section to at least one injection opening (27 and which, with its end remote from the combustion chamber, at Least indirectly protrudes into a fuel-filled spring chamber (37) in which a valve spring (41) is clamped, which acts on the valve member (21) in the closing direction arid is supported with its end remote from the valve member against a deflecting piston (45), which piston, during the supply of high pressure fuel to the fuel injection valve, can be moved by a certain stroke path into the spring chamber (37) and thereby increases the initial stress force of the valve spring (41), and having a connecting conduit between the spring chamber (37) and a low pressure fuel chamber (13), the improvement wherein the connecting conduit between the low pressure fuel chamber (73) and the spring chamber (37) is embodied as a throttle (99), wherein a high pressure pump (3) that delivers high pressure fuel constitutes a component together with the fuel injection valve (1) and this component is adapted to be inserted into a housing (7) of the engine to be supplied, and wherein an electric control valve (5) is disposed on the high pressure pump (3) in order to control the high pressure delivery of the high pressure pump (3), and wherein the deflecting piston (45) is guided in a hydraulic work chamber (81), which has two different diameters, wherein a first smaller diameter region (85) continuously communicates with a pump work chamber (63) of the high pressure pump (3) and a second larger diameter region (87) can be connected to the pump work chamber (63) only after the opening of a through flow cross section through a stroke motion of the deflecting piston (45) and that the deflecting piston (45) has two different hydraulic force introduction surfaces of which a first smaller force introduction surface (89) adjoins the first smaller diameter region (85) of the hydraulic work chamber (81) and a second larger force introduction surface (91) is disposed in the second larger diameter region (87) of the hydraulic work chamber (81).

7. The fuel injection valve according to claim 5, wherein the deflecting piston (45) has an annular collar (93) that adjoins the hydraulic work chamber (81) and whose annular end face oriented toward the pump work chamber (63) constitutes the second larger force introduction surface (91) and whose annular end face remote from the pump work chamber (63) constitutes a stop face (95) that cooperates with a stationary stroke stop face (97) in order to limit the stroke motion of the deflecting piston (45).

8. The fuel injection valve according to claim 5, wherein on its end remote from the pump work chamber (63), the deflecting piston has an upper spring plate (43) that protrudes into the spring chamber (37) and constitutes an adjustable counter support for the valve spring (41).

* * * * *

UNITED STATES PATENT AND TRADEMARK OFFICE

CERTIFICATE OF CORRECTION

PATENT NO. : 6,305,359 B1
DATED : October 23, 2001
INVENTOR(S) : Maximilian Kronberger et al.

It is certified that error appears in the above-identified patent and that said Letters Patent is hereby corrected as shown below:

Title page,
Item [75], add:

-- [75] Inventors: Raphael Combe, Vaugneray, France --

Signed and Sealed this

Ninth Day of April, 2002

*Attest:*

*Attesting Officer*

JAMES E. ROGAN
*Director of the United States Patent and Trademark Office*